US008450934B2

(12) United States Patent
Schmitt

(10) Patent No.: US 8,450,934 B2
(45) Date of Patent: May 28, 2013

(54) CIRCUIT ARRANGEMENT AND METHOD FOR OPERATING A LOW-PRESSURE DISCHARGE LAMP

(75) Inventor: Harald Schmitt, Munich (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 244 days.

(21) Appl. No.: 12/790,896

(22) Filed: May 31, 2010

(65) Prior Publication Data

US 2010/0308734 A1 Dec. 9, 2010

(30) Foreign Application Priority Data

Jun. 3, 2009 (DE) ..... 10 2009 023 787

(51) Int. Cl.
*H05B 41/36* (2006.01)

(52) U.S. Cl.
USPC ..... 315/127; 315/106; 315/207; 315/209 R; 315/225; 315/307

(58) Field of Classification Search
USPC ..... 315/106, 107, 200 R, 207, 208, 209 R, 315/224, 225, 226, 242, 243, 307, DIG. 7
See application file for complete search history.

(56) References Cited

U.S. PATENT DOCUMENTS 4,547,706 A * 10/1985 Krummel ..... 315/226
5,122,712 A * 6/1992 Hirschmann ..... 315/106
5,545,955 A 8/1996 Wood
5,559,394 A 9/1996 Wood
5,708,351 A * 1/1998 Takamoro ..... 307/150
5,757,141 A 5/1998 Wood
6,799,002 B2 * 9/2004 Birumachi ..... 399/67
2010/0225239 A1 * 9/2010 King ..... 315/224

FOREIGN PATENT DOCUMENTS

DE 3840845 A1 6/1990
DE 4005850 A1 8/1991
DE 19506977 A1 9/1995
EP 0113451 A1 7/1984
EP 0610642 A1 8/1994

OTHER PUBLICATIONS

European Search Report dated Oct. 6, 2010.
English language abstract of De 3840845 Al.

* cited by examiner

*Primary Examiner* — Douglas W Owens
*Assistant Examiner* — Thai Pham

(57) ABSTRACT

A circuit arrangement for operating a low-pressure discharge lamp may include a voltage source with two terminals; switches; and a series resonant circuit; a controller configured to control the switches such that an AC voltage is applied to the resonant circuit; a PTC thermistor coupled on one side to a circuit point of the resonant circuit and on the other side, at least one of via a diode, to the first terminal of the voltage source and, via a diode to the second terminal of the voltage source; a resistive element connected in series with a diode in the circuit between a terminal of the voltage source and the PTC thermistor; and an evaluation device configured to tap off the voltage drop across the resistive element and being coupled to the controller in order to deactivate the controller.

10 Claims, 2 Drawing Sheets

CIRCUIT ARRANGEMENT AND METHOD FOR OPERATING A LOW-PRESSURE DISCHARGE LAMP

CROSS-REFERENCE TO RELATED APPLICATION

This application claims priority to German Patent Application Serial No. 10 2009 023 787.9, which was filed Jun. 3, 2009, and is incorporated herein by reference in its entirety.

TECHNICAL FIELD

Various embodiments relate to a circuit arrangement for operating a low-pressure discharge lamp and to a method for operating a low-pressure discharge lamp in such a circuit arrangement.

BACKGROUND

A circuit arrangement is known from DE 38 40 845 A1 and also from DE 40 05 850 A1.

In this circuit arrangement there is a (DC) voltage source with two terminals, of which typically one is a ground terminal. The low-pressure discharge lamp is operated on an AC voltage. In order to generate an AC voltage switches are provided which are driven by suitable means for controlling the switches in such a way that at least one electrode of the low-pressure discharge lamp is coupled alternately to one terminal and the other terminal. In order to enable operation including starting in the low-pressure discharge lamp, a series resonant circuit is provided. Said series resonant circuit includes an inductive element which is connected in series with the low-pressure discharge lamp, i.e. is coupled with one terminal to the electrode of the low-pressure discharge lamp. The series resonant circuit furthermore includes a capacitive element or else a plurality of such capacitive elements, the at least one capacitive element being connected in series with the inductive element, to be precise in parallel with the low-pressure discharge lamp.

DE 38 40 845 A1 describes how gentle starting of the lamp is made possible: A circuit point of the series resonant circuit is connected to a PTC thermistor, and the PTC thermistor is coupled, via a diode, to the first terminal of the voltage source. In the example from DE 38 40 845 A1, the PTC thermistor is at the same time coupled, via a second diode, to the second terminal of the voltage source. For the purposes of the circuit, in principle one of the two diodes, e.g. the diode which is coupled to the ground terminal, is sufficient. The voltage present at the low-pressure discharge lamp is clamped by the diodes, i.e. only voltages which are lower than the voltage present at the voltage source are present across the low-pressure discharge lamp. These voltages are insufficient for starting. By virtue of the means for controlling the switches, the series resonant circuit is excited if it is also not yet at resonance. As a result, the electrodes of the low-pressure discharge lamp are preheated. At the same time, the PTC thermistor is heated. As soon as the PTC thermistor has a high resistance value, it is possible for there to be a higher voltage drop across the low-pressure discharge lamp than is present at the voltage source. The series resonant circuit enters resonance and there is a voltage drop which is sufficiently high for starting, a starting voltage, across the low-pressure discharge lamp. After starting, the voltage drop across the low-pressure discharge lamp again falls below that which is present at the voltage source. The PTC thermistor is then cooled down again, but during conventional operation there is no longer a current flowing via said PTC thermistor.

Anomalies may occur during operation of a low-pressure discharge lamp. The low-pressure discharge lamps demonstrate an excessively high lamp voltage in the case of some anomalies. These result in a high lamp power, and the increased lamp power in turn results in overheating of the ballast of the low-pressure discharge lamp, possibly also in local overheating of the low-pressure discharge lamp itself. The overheating brings about a hazardous situation.

An excessively high lamp voltage occurs in particular at the end of life of the lamp, possibly also in the event of contamination of the lamp. A hazardous situation can also occur in the event of a lamp with an excessively high power erroneously being fitted.

In order to avoid hazards, the new approach of detecting the lamp voltage has now been adopted. For this purpose, an additional winding can be provided on the lamp inductor, and an evaluation network is connected downstream of said additional winding. Likewise, capacitive coupling-out from the series resonant circuit can also take place and an evaluation network can be connected downstream.

A high degree of complexity is involved in the detection of the lamp voltage.

SUMMARY

A circuit arrangement for operating a low-pressure discharge lamp may include a voltage source with two terminals; switches; and a series resonant circuit; a controller configured to control the switches such that an AC voltage is applied to the resonant circuit; a PTC thermistor coupled on one side to a circuit point of the resonant circuit and on the other side, at least one of via a diode, to the first terminal of the voltage source and, via a diode to the second terminal of the voltage source; a resistive element connected in series with a diode in the circuit between a terminal of the voltage source and the PTC thermistor; and an evaluation device configured to tap off the voltage drop across the resistive element and being coupled to the controller in order to deactivate the controller.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
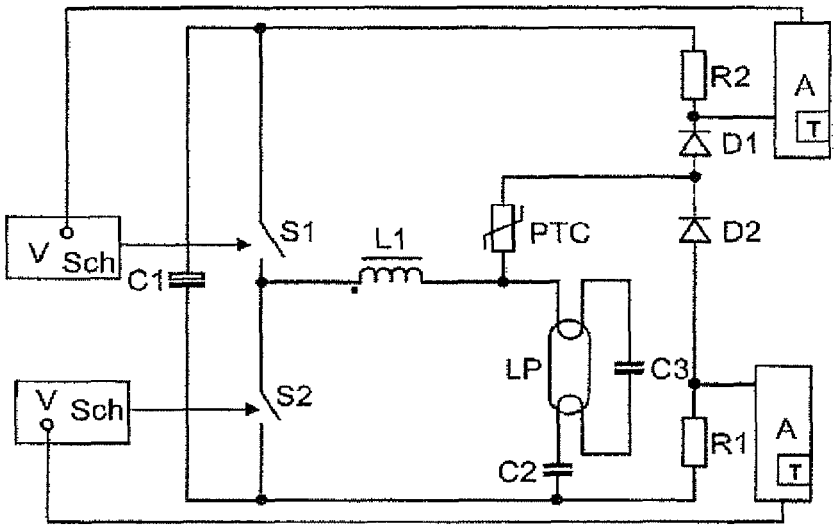
FIG. 1 shows elements of a circuit arrangement in accordance with an embodiment.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments provide a circuit arrangement for operating a low-pressure discharge lamp, in which hazards as a result of excessively high lamp voltages during operation of a low-pressure discharge lamp can be avoided without considerable complexity.

In the case of the circuit arrangement according to various embodiments, a resistive element is therefore connected in series with the associated diode in the circuit between a terminal of the voltage source and the PTC thermistor. An evaluation device taps off the voltage drop across the resistive element and is coupled to the means for controlling in order to deactivate said means.

Various embodiments are based on the knowledge that, in the event of an excessively high voltage across the low-pressure discharge lamp when using the circuit arrangement with the PTC thermistor and the at least one diode, currents flow via the PTC thermistor. Detection of an overvoltage across the low-pressure discharge lamp in this case does not need to take place at the low-pressure discharge lamp itself, but can be based on the current flowing via the PTC thermistor.

The circuit arrangement can include a full bridge, but has a particularly simple configuration if it includes only one half-bridge, namely two switches which are connected in series between the terminals of the voltage source, with a center tap between the switches being coupled to the inductive element of the series resonant circuit and therefore to one electrode of the low-pressure discharge lamp. When using only two switches in a half-bridge, at least one capacitive element is generally provided, for example between that electrode of the low-pressure discharge lamp which is not coupled to the inductive element and a terminal of the voltage source, typically the ground terminal.

There are various possibilities for the position of the circuit point. In this case, the following can also be added to the possibilities mentioned in the prior art: Either the circuit point is located between the inductive element and the at least one capacitive element, i.e. is therefore virtually at the potential of one electrode of the low-pressure discharge lamp, or the circuit point is a tap in one element of the series resonant circuit, i.e. either in the inductive element in the form of a tap which divides the latter into two parts or in the form of a tap between two capacitive elements which are connected in series, in parallel with the low-pressure discharge lamp. In the case of the two latter alternatives, a relatively high voltage drop across the low-pressure discharge lamp during preheating is enabled.

The evaluation device can have a particularly simple configuration if the resistive element is connected between a ground terminal of the voltage source and the PTC thermistor since in this case the voltage across the resistor can be measured with respect to ground.

Since the lamp running voltage is continuously subject to polarity reversal and the resistive element is connected in the connection with the diode, there is a voltage drop across the resistive element only in one polarity state, but not in the other. However, this is sufficient if the anomaly in the lamp running voltage is symmetrical, i.e. occurs to the same extent in the two polarity states. In principle asymmetrical anomalies can occur, i.e. the case in which the lamp running voltage is excessively high in one polarity state, but not in the other. If there is a voltage drop across the resistive element only when the lamp running voltage is excessively high in the other polarity state, the anomaly per se then cannot be identified. This can be remedied by virtue of the fact that two resistive elements are provided, with each being in a connection between the PTC thermistor and one of the two terminals of the voltage source which contains a diode. An evaluation device can then be arranged downstream of each resistive element. The evaluation devices can operate independently of one another, with in each case one evaluation device bringing about deactivation of the means for controlling to which it is coupled in the event of an anomaly in a polarity state being detected. In further refinements, even compensation between the two evaluation devices takes place. Thus, an AND gate could be arranged downstream of the two evaluation devices, for example; in this case, the means for controlling would only be deactivated when there is an anomaly in the two polarity states of the lamp running voltage.

In principle, it is possible for the circuit branch having the PTC thermistor with the diode to be provided purely for the purposes of detecting an overvoltage across the low-pressure discharge lamp. However, it is advantageous if this circuit branch performs the same purpose as in the prior art in accordance with DE 38 40 845 A1 and DE 40 05 850 A1, i.e. enables convenient preheating. In this case, the evaluation unit should not bring about deactivation during preheating. For this purpose, a timing element (for example a gradually charging capacitor) can be provided in said evaluation unit, and deactivation is only brought about by the evaluation device when there is a voltage drop above a threshold value across the resistor for a predetermined period of time, and the predetermined period of time being selected such that it is longer than a preheating time prior to starting of the low-pressure discharge lamp.

The period of time can be selected in such a way that the difference between said period of time and the preheating time is the maximum period of time over which a starting voltage of the low-pressure discharge lamp should be present. If the evaluation device is designed correspondingly such that it can detect the currents flowing via the PTC thermistor of the resistive element in the case of the starting voltage, the system is also switched off after this so-called starting burst duration, with the result that the starting voltage being applied for an excessively long period of time does not result in damage.

The method according to various embodiments for operating a low-pressure discharge lamp is based on a circuit arrangement, i.e. in accordance with the prior art, and furthermore includes the features that, once the low-pressure discharge lamp has been started, it is detected whether current is flowing via the PTC thermistor. If the current intensity of the current is greater than a predetermined threshold value for a predetermined period of time, the low-pressure discharge lamp is then switched off. It is therefore sufficient to investigate the branch with the PTC thermistor, otherwise no coupling-out elements need to be provided in the region of the low-pressure discharge lamp which can be used to couple out the high voltage drop there. The predetermined period of time is preferably greater than a preheating time prior to the starting of the low-pressure discharge lamp, as mentioned above, in order that the branch with the PTC thermistor and the diode in the circuit arrangement continues to be used for the purpose thereof known from the prior art.

The circuit arrangement according to various embodiments shown in FIG. 1 includes a DC voltage source, in this case symbolized by the smoothing capacitor C1 connected to the two terminals. In order to operate a low-pressure discharge lamp LP on an alternating current, a half-bridge is provided, i.e. a series circuit including switches S1 and S2 in parallel with the capacitor C1. A tap between the two switches S1 and S2 is coupled to an electrode of the lamp LP. The other electrode of the lamp LP is coupled to ground via a capacitor C2. The switches S1 and S2 are now switched off and on alternately. When the switch S1 is switched on, a current flows to the lamp LP in a first direction, and when the switch S1 switches off and the switch S2 switches on, a current flows in the opposite direction.

In order for it to be possible for the lamp LP to be operated, including the initial starting, a resonant circuit is provided, to be precise the tap between the switches S1 and S2 is coupled to a terminal of an inductive element L1, whose other terminal is coupled to the electrode of the lamp LP. A capacitor C3 is connected in parallel with the lamp. The inductive element L1 and the capacitor C3 together form a series resonant circuit: Given a suitable selection of the elements which is appropriate in relation to the clock with which the switches S1 and S2 are driven, the resonant circuit enters resonance and a particularly high voltage drop occurs across the lamp LP, which is sufficient for starting. When driving the switches S1 and S2, in this case simple circuits should be used; by way of example a circuit Sch illustrated symbolically is shown for the switch S2. Driving of the switches S1 and S2 by a microcontroller is not necessary.

First, the lamp LP needs to be preheated before it is started in order that it has a long life and functions in optimum fashion during operation. It is therefore essential for the starting voltage not to be reached too quickly. For this purpose, the electrode-side terminal of the inductive element L1 is coupled to both the terminals of the DC voltage source, i.e. the capacitor C1 in the illustration, via a PTC thermistor PTC and via diodes D1 and D2. The diodes D1 and D2 are connected in such a way that they clamp the lamp voltage: As soon as a potential is present at the upper (in FIG. 1) electrode of the lamp LP, said potential exceeding or falling below the potential of a terminal of the DC voltage source, a current flows via the diode D1 or via the diode D2, respectively. Therefore, the voltage across the lamp continues to be limited as long as the PTC thermistor PTC has a low resistance, and therefore initially starting does not take place. In this phase, the filaments of the lamp LP, i.e. the electrodes, are preheated. During preheating, the PTC thermistor PTC is heated at the same time. As soon as said PTC thermistor has a high resistance value, the branch with the PTC thermistor PTC and the diodes D1 and D2 no longer has a substantial influence on the voltage across the lamp, and the series resonant circuit with the elements L1 and C3 can enter resonance until the starting voltage drops across the lamp LP and starting takes place.

Various embodiments are concerned with the problem of it being possible for excessively high voltages to occur during operation of the lamp, namely after starting. Use is now made of the fact that the PTC thermistor PTC is cooled again and achieves a low resistance value after a period of operation of the lamp. If the lamp running voltage LP is too high, a current therefore flows via the diodes D1 and D2. This can be detected: The previously described circuit arrangement of the type known per se is supplemented by a resistive element R1, in this case in series with the diode D2, i.e. towards the ground terminal. An evaluation device A detects the voltage drop across the resistive element R1. If this voltage is too high for a predetermined period of time, the evaluation device A causes a potential V in the circuit Sch to change, with the result that the switch S2 is no longer actuated. The lamp LP is therefore switched off. Possibly, the evaluation device can also have influence on a further circuit for the switch S1. The evaluation device includes a timing element T, for example a gradually charging capacitor with a high capacitance. A voltage drop across the capacitor determines a potential at the control input or gate of a transistor and therefore the potential V, which ensures functioning of the circuit Sch, by virtue of which the switch S2 is opened. If the voltage across the capacitor reaches a target value, the switch S2 remains permanently open, with the result that the lamp LP is shut down. The capacitor in the evaluation device A by virtue of which the switch S2 is opened is now intended to be selected in such a way that the period of time before shut down of the lamp LP is longer than the desired preheating time. In this case, shut down does not take place during preheating. Given a preheating time of 2 seconds, the timing element in the evaluation device A can be selected, for example, such that shut down takes place after 2.5 seconds. When the lamp LP is first brought into operation, shut down therefore would only occur when the starting voltage has been applied after a preheating time of 2 seconds for a period of time of 0.5 second. Then, shut down is also brought about when the lamp LP has not yet started. A period of time of 2.5 seconds is also acceptable if overvoltages are intended to be avoided across the lamp LP during later operation, since 2.5 seconds is insufficient for excessive overheating to take place.

Figure 2:
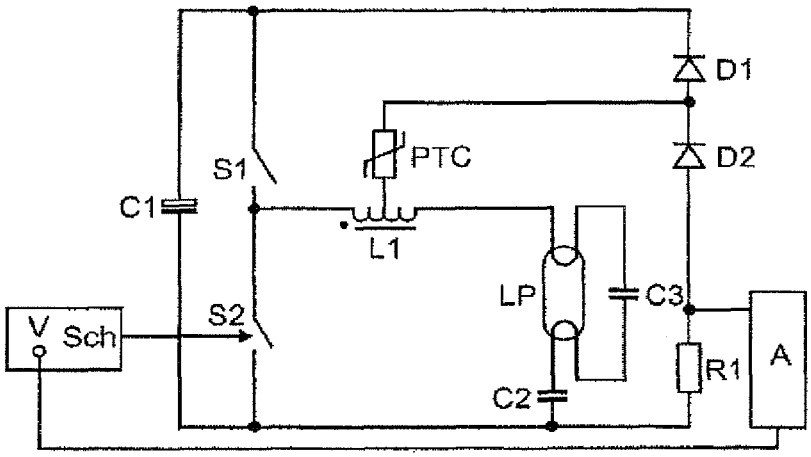
FIG. 2 shows elements of a circuit arrangement in accordance with an embodiment.
Figure 3:
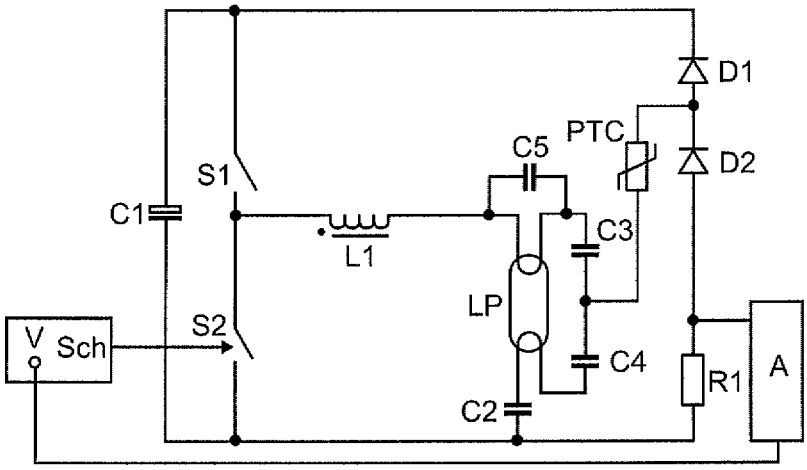
FIG. 3 shows elements of a circuit arrangement in accordance with an embodiment.

FIG. 2 and FIG. 3 show developments of the embodiments shown in FIG. 1 which differ from the circuit arrangement shown in FIG. 1 by the circuit point, which is coupled to the PTC thermistor PTC:

In the embodiment shown in FIG. 2, a tap is provided in the inductive element L1, and this tap is coupled to the PTC thermistor PTC.

In the development shown in FIG. 3, a series circuit including two capacitors C3 and C4 is provided in parallel with the lamp LP instead of an individual capacitor C3, and the circuit point between the two capacitors C3 and C4 is coupled to the PTC thermistor PTC.

These types of development known per se from the prior art are in this case implemented using the circuit arrangement according to the invention which has the resistive element R1 and the evaluation device A, which in this case is coupled to the circuit Sch.

A common factor of the three embodiments illustrated is the fact that a resistive element R1 is provided, and an evaluation device A is associated with said resistive element R1. The resistive element R1 is connected in series with the diode D2. It is possible to extend the circuits shown in FIGS. 1 to 3 to the extent that a resistive element R2 is also provided in the branch between the PTC thermistor PTC and a voltage terminal, which includes the diode D1, and to the extent that an evaluation device is also associated with this resistive element, said evaluation device tapping off the voltage drop across this resistive element and equally being suitable for changing the voltage V of a circuit Sch to a switch S1 or S2 and thereby bringing about shutdown of the respective switch and causing said switch to remain shutdown. This modification would safely bring about shutdown of the lamp LP even in the case of those anomalies in which the lamp running voltage is only abnormal in one polarity state.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A circuit arrangement for operating a low-pressure discharge lamp, the circuit arrangement comprising:

a voltage source with two terminals;

switches; and a series resonant circuit, which comprises an inductive element which is coupled to an electrode of the low-pressure discharge lamp, and which comprises at least one capacitive element which is connected in series with the inductive element and in parallel with the low-pressure discharge lamp;

a controller configured to control the switches in such a way that an AC voltage is applied to the series resonant circuit;

a PTC thermistor, which is coupled on one side to a circuit point of the series resonant circuit and on the other side to, at least one of:

a) the cathode of a second diode, the anode of the second diode being coupled to the second terminal of the voltage source and b) the anode of a first diode, the cathode of the first diode being coupled to the first terminal of the voltage source;

the circuit arrangement further comprising a resistive element connected in series with the second diode in the circuit between one of the terminals of the voltage source and the PTC thermistor; and an evaluation device configured to tap off the voltage drop across the resistive element and being coupled to the controller in order to deactivate the controller.

2. The circuit arrangement as claimed in claim 1, further comprising: two switches, which are connected in series between the terminals of the voltage source, a center tap between the switches being coupled to the inductive element.

3. The circuit arrangement as claimed in claim 1, wherein the circuit point is between the inductive element and the at least one capacitive element.

4. The circuit arrangement as claimed in claim 1, wherein the circuit point is a tap in the inductive element.

5. The circuit arrangement as claimed in claim 1, wherein the series resonant circuit has two capacitive elements, which are connected in series, in parallel with the low-pressure discharge lamp; and wherein the circuit point is between the two capacitive elements.

6. The circuit arrangement as claimed in claim 1, wherein the resistive element is connected in the path between a ground terminal of the voltage source and the PTC thermistor.

7. The circuit arrangement as claimed in claim 1, the circuit arrangement further comprising a second resistive element connected in series with the first diode in the circuit between the second terminal of the voltage source and the PTC thermistor, with a second evaluation device being associated with the second resistive elements, the second evaluation device being configured to tap off the voltage drop across the respective resistive element and being coupled to the means for controlling in order to deactivate said means.

8. The circuit arrangement as claimed in claim 1, wherein the evaluation device comprises a timing element, with the result that a deactivation is brought about when there is a voltage drop above a threshold value across the resistive element for a predetermined period of time, the predetermined period of time being longer than a preheating time prior to starting of the low-pressure discharge lamp.

9. A method for operating a low-pressure discharge lamp with a circuit arrangement, the circuit arrangement comprising:

a voltage source with two terminals;

switches; and a series resonant circuit, which comprises and inductive element which is coupled to an electrode of the low-pressure discharge lamp, and which comprises at least one capacitive element which is connected in series with the inductive element and in parallel with the low-pressure discharge lamp;

a controller configured to control the switches in such a way that an AC voltage is applied to the series resonant circuit;

a PTC thermistor, which is coupled on one side to a circuit point of the series resonant circuit and on the other side to, at least one of:

a) the cathode of a second diode, the anode of the second diode being coupled to the second terminal of the voltage source and, b) the anode of a first diode, the cathode of the first diode being coupled to the second first terminal of the voltage source;

the circuit arrangement further comprising a resistive element connected in series with the second diode in the circuit between one of the terminals of the voltage source and the PTC thermistor; and an evaluation device configured to tap off the voltage drop across the resistive element and being coupled to the controller in order to deactivate the controller;

the method comprising:

once the low-pressure discharge lamp has been started, detecting whether current is flowing via the PTC thermistor; and switching off the low-pressure discharge lamp if the current intensity of such a current is greater than a predetermined threshold value for a predetermined period of time.

10. The method as claimed in claim 9, wherein the predetermined period of time is longer than a preheating time prior to starting of the low-pressure discharge lamp.

* * * * *